US006506027B1

(12) United States Patent
Timuska

(10) Patent No.: US 6,506,027 B1
(45) Date of Patent: Jan. 14, 2003

(54) TWO STAGE COMPRESSOR AND A METHOD FOR COOLING SUCH A COMPRESSOR

(75) Inventor: Karlis Timuska, Stockholm (SE)

(73) Assignee: Svenska Rotor Maskiner AB, Stockholm (SE)

( * ) Notice: Subject to any disclaimer, the term of this patent is extended or adjusted under 35 U.S.C. 154(b) by 0 days.

(21) Appl. No.: 09/700,261

(22) PCT Filed: Apr. 30, 1999

(86) PCT No.: PCT/SE99/00713

§ 371 (c)(1),
(2), (4) Date: Nov. 9, 2000

(87) PCT Pub. No.: WO00/00744

PCT Pub. Date: Jan. 6, 2000

(30) Foreign Application Priority Data

Jun. 17, 1998 (SE) ..... 9802156

(51) Int. Cl.[7] ..... F04B 3/00

(52) U.S. Cl. ..... 417/251; 417/297; 62/84; 62/179

(58) Field of Search ..... 417/251, 243, 417/248, 313, 297; 418/100; 384/620; 62/84, 179

(56) References Cited

U.S. PATENT DOCUMENTS 3,191,854 A 6/1965 Lowler et al.
3,848,422 A * 11/1974 Schibbye ..... 62/84
3,859,815 A * 1/1975 Kasahara ..... 62/179
3,947,078 A * 3/1976 Olsaker ..... 384/620
5,653,585 A * 8/1997 Fresco ..... 418/100
6,287,088 B1 * 9/2001 Nishimura et al. ..... 417/297

* cited by examiner

*Primary Examiner*—Teresa Walberg
*Assistant Examiner*—Quang Van

(57) ABSTRACT

A helical screw compressor is provided having a first compressor stage and a second compressor stage. The helical screw compressor includes a first male rotor and a first female rotor in the first compressor stage, and a second male rotor and a second female rotor in the second compressor stage. A connecting duct is provided between an outlet of the first compressor stage and an inlet of the second compressor stage, and a conduit is provided having a first end communicating with the connecting duct and a second end branching off into a first line and a second line. The first line is coupled to the first compressor stage for injecting liquid into the first compressor stage, and the second line is coupled to the second compressor stage for injecting liquid into the second compressor stage. In addition, a pump is provided in the conduit for transporting liquid precipitate from the connecting duct to the first and second compressor stages, and a heat exchanger is provided in the conduit between the pump and the first and second lines.

20 Claims, 2 Drawing Sheets

TWO STAGE COMPRESSOR AND A METHOD FOR COOLING SUCH A COMPRESSOR

This application is the U.S. national phase application of International application No. PCT/SE99/00713 filed Apr. 30, 1999.

BACKGROUND OF THE INVENTION

The present invention relates to a two-stage helical screw compressor that includes liquid injection in both stages, wherein the compressor includes a male and a female rotor in each stage and a connecting duct which is disposed between the outlet in the first compressor stage and the inlet in the second compressor stage and through which gas that has been compressed in the first stage is delivered to said second stage. The invention also relates to a method of cooling a two-stage compressor in which liquid is injected into both stages and gas that has been compressed in the first stage is delivered to the second stage through a duct connecting between the outlet in a first compressor stage and the inlet in a second compressor stage.

It is known to use a liquid, for instance a lubricant such as oil, to cool the compressor and therewith the compressed gas, to lubricate and seal the helical rotors against the rotor housing. For this purpose this liquid in finely divided form is injected into the working chambers of the compressor.

When using multi-stage compressors, the liquid-containing gas is passed from one stage to the next stage via a connecting duct. The hot oil-containing gas obtained from the first compression stage is delivered to the second compression stage, wherewith the temperature of the oil present in the gas has also been raised. The temperature of the oil is raised still further in this second stage. Consequently, in order to cool the compressor it is necessary to inject cold oil into this other stage, in the same way as that carried out in the first stage.

When there is no need to run the compressor at full capacity, the compressor stages are relieved of load, normally with the aid of a slide valve or a radially disposed lifting valve that generates a short circuit between the compressor working chambers, i.e. interconnects two mutually adjacent or juxtaposed working chambers. This destabilises the secondary drive rotor, most often the female rotor. This destabilisation results in "chattering" of the rotors and also in rotor wear and loud noise.

OBJECT OF THE INVENTION

The object of the present invention is to provide for improved cooling of two-stage compressors and therewith also improved compression in such compressors, by ensuring that most of the lubricant delivered to the second compressor stage has a low temperature.

This object is achieved with a helical screw two-stage compressor in which a pump functions to transport liquid precipitate present in the connecting duct through a heat exchanger and delivers the liquid cooled in the heat exchanger to the two compressor stages. The object is also achieved by a method which includes separating in the connecting duct the liquid injected in the first compressor stage and cooling the separated liquid in a heat exchanger and thereafter injecting the cooled liquid into both compressor stages.

Advantageous embodiments of the inventive compressor and inventive method will be apparent from the claims.

The rotor that is driven directly by drive means in a helical screw compressor is normally the male rotor. The female rotor is caused to rotate by the driven-male rotor. When relieving the compressor of load, so that the compressor runs in an idling mode or delivers only a partial load, there is a tendency for the secondarily driven rotor to destabilise and begin to chatter or rattle. This results in undesirable noise and also in wear on both rotors. By allowing the secondarily driven rotor to drive the pump that circulates the lubricating and sealing liquid, the secondarily driven rotor will be subjected to load and therewith stabilise and no longer rattle. The female rotor in the first stage will preferably drive the circulation pump.

BRIEF DESCRIPTION OF THE DRAWINGS

The present invention will now be described in more detail with reference to an exemplifying embodiment thereof and also with reference to the accompanying drawings, in which.

DETAILED DESCRIPTION

Figure 1:
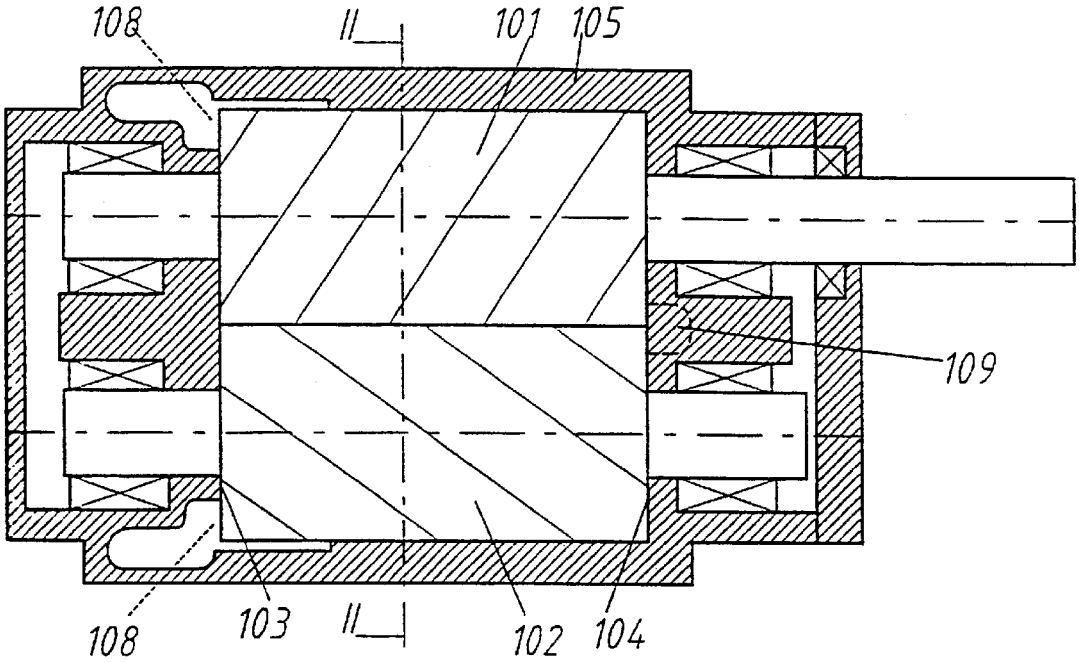
FIG. 1 is a longitudinal section view of a known helical screw compressor.

The construction and working principle of a helical screw compressor will now be described briefly with reference to FIGS. 1 and 2.

A pair of mutually engaging helical rotors 101, 102 are rotatably mounted in a working chamber that is defined by two end walls 103, 104 and a barrel wall 105 extending therebetween. The barrel wall 105 has a form which corresponds generally to the form of two mutually intersecting cylinders, as evident from FIG. 2. Each rotor 101, 102 has several lobes 106 and 107 respectively, and intermediate grooves which extend helically along the rotor. One rotor, 101, is a male rotor type with the major part of each lobe 106 located outwardly of the pitch circuit, and the other rotor, 102, is a female type rotor with the major part of each lobe 107 located inwardly of the pitch circle. The female rotor 102 will normally have more lobes than the male rotor 101. A typical combination is one in which the male rotor 101 has four lobes and the female rotor 102 has six lobes.

The gas to be compressed, normally air, is delivered to the working chamber of the compressor through an inlet port 108 and is then compressed in V-shaped working chambers defined between the rotors and the chamber walls. Each working chamber moves to the right in FIG. 1 as the rotors 101, 102 rotate. The volume of a working chamber thus decreases continuously during the latter part of its cycle, subsequent to communication with the inlet port 108 having been cut off. The gas is therewith compressed and the compressed gas leaves the compressor through an outlet port 109. The outlet to inlet pressure ratio is determined by the built-in volumetric relationship between the volume of a working chamber immediately after its communication with the inlet port 108 has been cut off and the volume of said working chamber when it begins to communicate with the outlet port 109.

Figure 2:
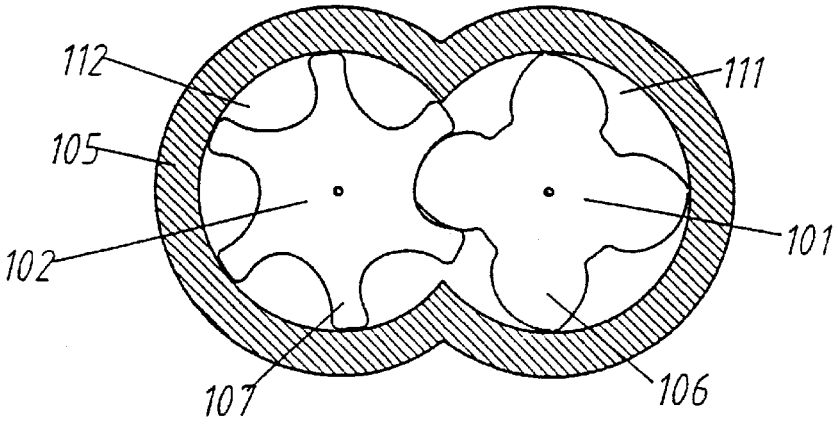
FIG. 2 is a sectional view taken on the line II—II in FIG. 1.
Figure 3:
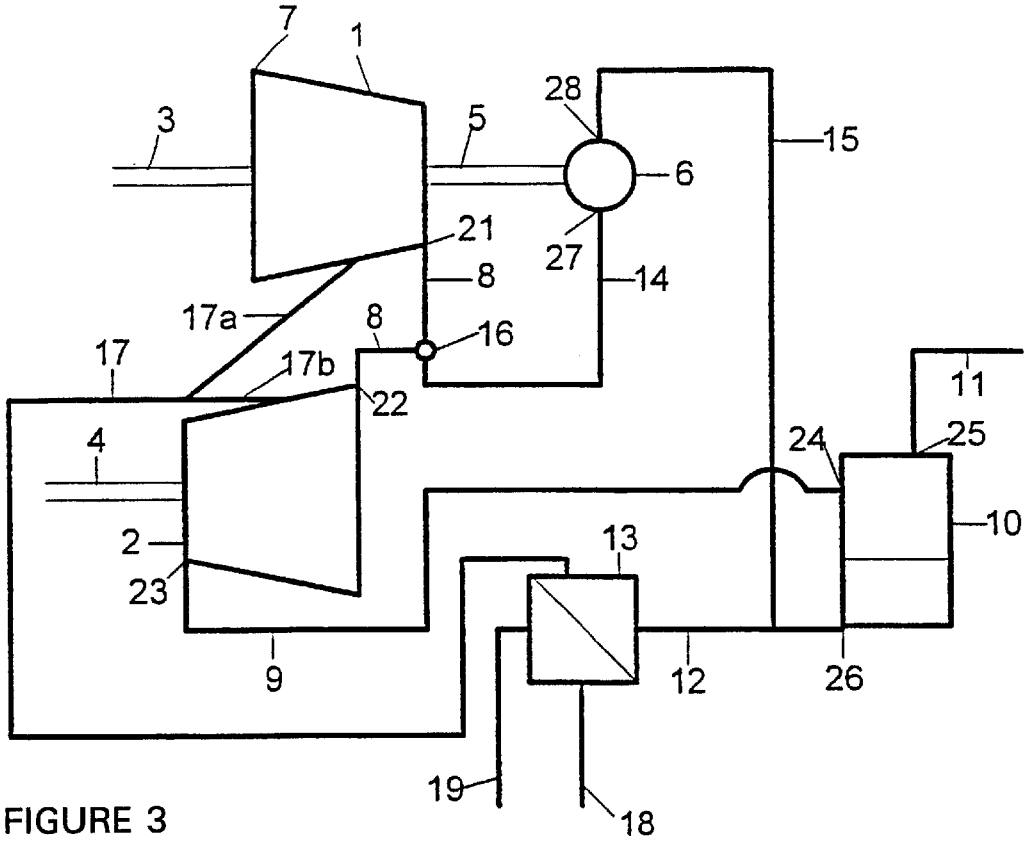
FIG. 3 is a circuit diagram illustrating a first embodiment of an inventive helical screw compressor.

FIG. 3 illustrates diagrammatically a helical screw compressor that has two compressor stages 1, 2, where each compressor stage 1, 2 has the structural design described in FIGS. 1 and 2. A lubricant is supplied to the working chambers of the compressor stages 1, 2, for sealing between the rotor housing and the rotor lobes and for lubricating and cooling purposes. The lubricant may be oil, water or a water-based liquid, for instance water with additive(s). The compressor stages 1, 2 are shown as two mutually separate units. The first compressor stage 1 includes a drive shaft 3 for driving the male rotor of the compressor. The second compressor stage 2 has a drive shaft 4. This compressor stage 2 is also driven by its male rotor. The drive shafts 3, 4 can be driven individually by respective drive means (not shown) or may be mutually connected by gearing or in some other way such as to be driven by one single drive means.

The first compressor stage 1 also includes a second drive shaft 5 which is driven by the female rotor of the compressor stage 1. The other end of this drive shaft 5 is connected to a pump 6 and functions as the pump drive shaft.

The first compressor stage 1 has an inlet 7 for gas to be compressed in the first stage and an outlet 21 for the gas compressed in the first stage. The outlet 21 is connected to the inlet 22 of the second compressor stage 2 by a duct 8. The second compressor stage has a compressed gas outlet 23. This outlet 23 is connected to an inlet 24 of a liquid separator 10 via a conduit 9.

Arranged in the upper part of the liquid separator 10 is a first outlet 25 to which there is connected a conduit 11 for exiting compressed gas. A liquid outlet 26 (lubricant outlet) is provided in the lower part of said separator. The second outlet 26 (liquid outlet)of the liquid separator 10 is connected to and discharges into the working chambers of the compressor stages 1, 2 via a conduit 12, a heat exchanger 13 and a further conduit 17, this latter conduit 17 branching into branch-conduits 17*a* and 17*b* upstream of the compressor stages 1 and 2.

The pump inlet 27 is connected by a conduit 14 to the connecting duct 8 that mutually connects the two compressor stages 1, 2. The pump outlet 28 is connected to the conduit 12 between the liquid separator 10 and the heat exchanger 13, by means of a further conduit 15.

The heat exchanger 13 is cooled either by blowing fan air onto the heat exchanger or by means of a fluid which enters the heat exchanger via an inlet conduit 18 and leaves the same via an outlet conduit 19. The fluid may be either a liquid or a gas.

A liquid trap or phase separator 16 may be provided in the connecting duct 8 that joins the outlet 21 of the compressor stage 1 to the inlet 22 of the compressor stage 2. In this case, the conduit 14 opens out between the connecting duct 8 and the pump 6 in the bottom region of the liquid trap or phase separator 16.

In operation, a fluid, for example air, is delivered to the first compressor stage 1 through the inlet 7. Lubricant is delivered at the same time to the working chambers of this stage, through the branch conduit 17*a*. The lubricant-containing gas compressed in this stage is delivered through the connecting duct 8 to the second compressor stage 2 in which it is further compressed.

As the compressed lubricant-containing gas passes through the connecting duct 8, the major part of the lubricant present is separated from the gas in the liquid trap or the phase separator 16, this lubricant being passed to the conduit 12 and the heat exchanger 13 via the pump for cooling purposes.

The major part of the lubricant required in the second compressor stage 2 is delivered to the working chambers of this stage through the branch conduit 17*b*, said lubricant having been cooled in the heat exchanger 13.

The lubricant-containing gas compressed in the second compressor stage 2 is delivered to the liquid separator 10 via the conduit 9. Lubricant is separated from the gas in the liquid separator 10. The lubricant collects on the bottom of the liquid separator 10 and the gas collects in the upper part of said separator. The gas leaves the liquid separator 10 through the conduit 11 and the lubricant is passed to the heat exchanger 13 and cooled therein. The cooled lubricant is then transported to respective working chambers of the compressor stages 1 and 2 through conduits 17 and 17*a* and 17*b*.

Figure 4:
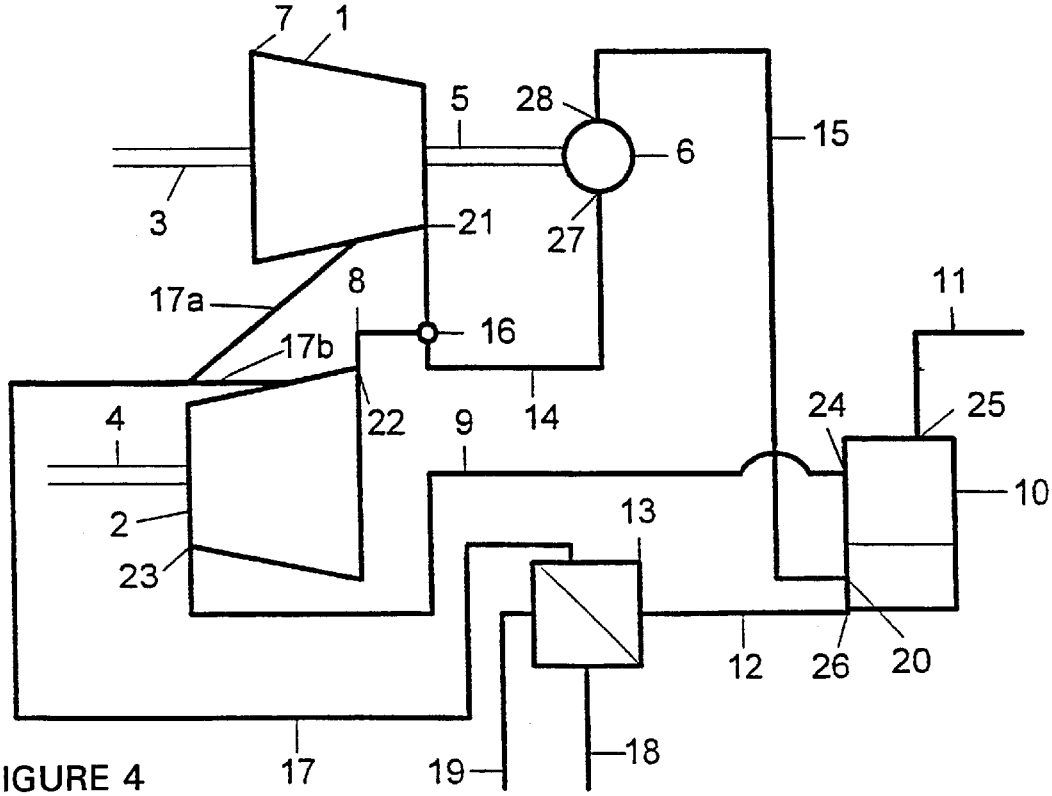
FIG. 4 is a circuit diagram illustrating a second embodiment of an inventive helical screw compressor.

The arrangement illustrated in FIG. 4 differs from the FIG. 3 arrangement in that the conduit 15 from the pump 6 opens into the liquid separator 10 instead of into the conduit 12 that connects the liquid separator 10 to the heat exchanger 13. To this end, the liquid separator 10 has provided in its lower part a second inlet 20 that ensures that liquid will be delivered by the conduit 15 at a level beneath the level of liquid in the liquid separator 10.

In this embodiment, lubricant in which gas has dissolved and which has been delivered by the pump 6 to the liquid separator 10 from the connecting duct 8 can be freed from part of its gas content.

The lubricant used in accordance with the invention may be oil, water or a water-based lubricant, i.e. water plus additive(s).

Because the pump is driven by a direct coupling to the female rotor of the first compressor stage 1, this rotor will be imparted a retarding moment which counteracts and/or prevents torsional oscillation of the rotor. Such torsional oscillations occur particularly when the compressor, i.e. the compressor stage 1, is relieved of load and when the torque transmitted by the gas forces to the female rotor is close to zero.

The load on the compressor can be relieved or its capacity adjusted with the aid of a lift valve in the rotor housing, in a radial direction from the rotor shaft or shafts. The compressor can alternatively be relieved of its load or its capacity adjusted with the aid of a slide valve that short-circuits, i.e. interconnects, mutually adjacent working chambers.

What is claimed is:

1. A helical screw compressor having a first compressor stage and a second compressor stage, and in which liquid is injected in both the first compressor stage and the second compressor stage, said helical screw compressor comprising:

a male rotor and a female rotor in each of the first and second compressor stages;

a connecting duct which extends between an outlet of the first compressor stage and an inlet of the second compressor stage and through which gas that has been compressed in the first compressor stage is delivered to the second compressor stage; and a pump which transports liquid precipitate present in the connecting duct through a heat exchanger and which delivers the liquid cooled in the heat exchanger to both the first and second compressor stages;

wherein the pump is driven by one of the rotors in the first compressor stage.

2. The helical screw compressor according to claim 1, wherein the pump is driven by the female rotor of the first compressor stage.

3. A helical screw compressor having a first compressor stage and a second compressor stage, and in which liquid is injected in both the first compressor stage and the second compressor stage, said helical screw compressor comprising:

a male rotor and a female rotor in each of the first and second compressor stages;

a connecting duct which extends between an outlet of the first compressor stage and an inlet of the second compressor stage and through which gas that has been compressed in the first compressor stage is delivered to the second compressor stage; and a pump which transports liquid precipitate present in the connecting duct through a heat exchanger and which delivers the liquid cooled in the heat exchanger to both the first and second compressor stages;

wherein the connecting duct comprises one of a liquid trap and a separation chamber in which liquid is separated from gas.

4. A method of cooling a helical compressor having a first compressor stage and a second compressor stage, said method comprising:

delivering gas that has been compressed in the first compressor stage to the second compressor stage through a connecting duct disposed between an outlet of the first compressor stage and an inlet of the second compressor stage;

separating liquid present in the connecting duct and cooling the separated liquid in a heat exchanger; and injecting the liquid cooled in the heat exchanger into both the first and second compressor stages;

wherein the liquid from the connecting duct is transported through the heat exchanger and injected into the first and second compressor stages by a pump driven by the compressor.

5. A helical screw compressor having a first compressor stage and a second compressor stage, said helical screw compressor comprising:

a first male rotor and a first female rotor in the first compressor stage, and a second male rotor and a second female rotor in the second compressor stage;

a connecting duct between an outlet of the first compressor stage and an inlet of the second compressor stage;

a conduit having a first end communicating with the connecting duct and having a second end branching off into a first line and a second line, said first line being coupled to the first compressor stage for injecting liquid into the first compressor stage, and said second line being coupled to the second compressor stage for injecting liquid into the second compressor stage;

a pump provided in the conduit for transporting liquid precipitate from the connecting duct to the first and second compressor stages; and a heat exchanger provided in the conduit between the pump and the first and second lines.

6. The helical screw compressor according to claim 5, wherein the pump is driven by one of the rotors in the first compressor stage.

7. The helical screw compressor according to claim 6, wherein the pump is driven by the first female rotor of the first compressor stage.

8. The helical screw compressor according to claim 5, wherein the connecting duct comprises one of a liquid trap and a separation chamber in which liquid is separated from gas.

9. The helical screw compressor according to claim 5, further comprising a liquid separator disposed between the pump and the heat exchanger.

10. The helical screw compressor according to claim 9, wherein an outlet of the second compressor stage is coupled to the liquid separator.

11. The helical screw compressor according to claim 10, wherein liquid separator comprises a liquid outlet coupled to the heat exchanger.

12. The helical screw compressor according to claim 9, wherein liquid separator comprises a liquid outlet coupled to the heat exchanger.

13. The helical screw compressor according to claim 5, wherein the liquid comprises one of oil, water and a water-based lubricant.

14. A method of cooling a helical compressor having a first compressor stage and a second compressor stage, said method comprising:

delivering gas that has been compressed in the first compressor stage to the second compressor stage through a connecting duct disposed between an outlet of the first compressor stage and an inlet of the second compressor stage; and transporting liquid precipitate from the connecting duct to the first and second compressor stages via a conduit having a first end communicating with the connecting duct and having a second end branching off into a first line and a second line, said first line being coupled to the first compressor stage for injecting liquid into the first compressor stage, and said second line being coupled to the second compressor stage for injecting liquid into the second compressor stage;

wherein a heat exchanger is provided in the conduit between the pump and the first and second lines for cooling the liquid prior to injecting the liquid into the first and second compressor stages.

15. The method according to claim 14, wherein essentially all liquid injected into the first compressor stage is separated.

16. The method according to claim 15, wherein liquid exiting the second compressor stage is separated in a liquid separator, and the separated liquid is then delivered to the heat exchanger.

17. The method according to claim 16, wherein liquid from the first compressor stage is also delivered to the liquid separator.

18. The method according to claim 14, wherein liquid exiting the second compressor stage is separated in a liquid separator, and the separated liquid is then delivered to the heat exchanger.

19. The method according to claim 18, wherein liquid from the first compressor stage is also delivered to the liquid separator.

20. The method according to claim 14, wherein the liquid from the connecting duct is transported through the heat exchanger and injected into the first and second compressor stages by a pump driven by the compressor.

* * * * *